US011324260B2

(12) United States Patent
Tinch et al.

(10) Patent No.: US 11,324,260 B2
(45) Date of Patent: May 10, 2022

(54) SHIRT COLLAR STIFFENING DEVICE

(71) Applicant: Nick T. Tinch, Manassas, VA (US)

(72) Inventors: Nick T. Tinch, Manassas, VA (US); Paul Maguire, Goochland, VA (US)

(73) Assignee: Nick T. Tinch, Manassas, VA (US)

( * ) Notice: Subject to any disclaimer, the term of this patent is extended or adjusted under 35 U.S.C. 154(b) by 0 days.

(21) Appl. No.: 17/315,059

(22) Filed: May 7, 2021

(65) Prior Publication Data

US 2021/0345687 A1 Nov. 11, 2021

Related U.S. Application Data

(60) Provisional application No. 63/022,232, filed on May 8, 2020.

(51) Int. Cl.
*A41B 3/06* (2006.01)

(52) U.S. Cl.
CPC ..... *A41B 3/06* (2013.01)

(58) Field of Classification Search
CPC .... A41B 3/06; A41B 3/08; A41B 1/14; A41B 3/18; A41D 27/16
See application file for complete search history.

(56) References Cited

U.S. PATENT DOCUMENTS 692,098 A * 1/1902 Woodbury ..... A41B 3/12 24/900.1
1,294,085 A * 2/1919 Goodman ..... A41B 3/12 2/137
2,475,931 A * 7/1949 Wimmer ..... A41D 25/06 D2/609

(Continued)

FOREIGN PATENT DOCUMENTS

DE 841731 6/1952
DE 888982 9/1953

(Continued)

OTHER PUBLICATIONS

International Search Report and Written Opinion for PCT Appl. No. PCT/US2021/031445, dated Aug. 26, 2021, 9 pages.

(Continued)

*Primary Examiner* — Alissa L Hoey

(74) *Attorney, Agent, or Firm* — Patent Law of Virginia, PLLC; Brian J. Teague

(57) ABSTRACT

A shirt collar stiffening device comprises an elongated bendable main body, a first elongated bendable length adjustment member with a first collar stay member pivotably attached, and a second elongated bendable length adjustment member with a second collar stay member pivotably attached. The elongated bendable main body has a first plurality of loops projecting outward from a first side, and a second plurality of loops projecting outward from a second side. The first elongated bendable length adjustment member is slidably engageable with the main body by inserting a proximal end of the first length adjustment member through two of more of the first plurality of loops of the main body. The second elongated bendable length adjustment member is slidably engageable with the main body by inserting a proximal end of the second length adjustment member through two of more of the second plurality of loops of the main body.

12 Claims, 7 Drawing Sheets

(56) References Cited

U.S. PATENT DOCUMENTS

| | | | | |
|---|---|---|---|---|
| 2,551,879 | A * | 5/1951 | Freedman | B65D 85/182 223/83 |
| 2,740,125 | A * | 4/1956 | Spevak | A41B 3/06 2/132 |
| 2,899,681 | A * | 8/1959 | Oscard | A41B 3/06 2/132 |
| 2,903,703 | A * | 9/1959 | Blish | A41B 3/12 2/137 |
| 3,793,645 | A * | 2/1974 | Kadison | A41F 9/025 2/221 |
| 5,920,964 | A * | 7/1999 | Malzahn | A41F 9/002 24/442 |
| 9,171,280 | B2 | 10/2015 | Gitchell et al. | |
| 9,526,274 | B2 | 12/2016 | English | |
| 10,039,328 | B2 | 8/2018 | English | |
| D913,643 | S * | 3/2021 | Tinch | D2/859 |
| 2006/0218695 | A1 | 5/2006 | Boos | |
| 2008/0276347 | A1* | 11/2008 | Alfin | A41B 3/12 2/129 |
| 2010/0313331 | A1 | 12/2010 | English | |
| 2011/0113526 | A1 | 5/2011 | Harris | |
| 2014/0345031 | A1* | 11/2014 | Reidsema | A41B 3/06 2/132 |
| 2015/0020290 | A1 | 1/2015 | Yarbrough | |
| 2017/0311649 | A1 | 11/2017 | Garcia | |
| 2020/0037672 | A1 | 2/2020 | Moczygemba | |
| 2020/0146362 | A1* | 5/2020 | Smith | A41B 3/06 |
| 2020/0221790 | A1* | 7/2020 | Mohammadian-Khezerlou | A41B 3/06 |
| 2021/0169151 | A1* | 6/2021 | Chohan | A41B 3/06 |

FOREIGN PATENT DOCUMENTS

| | | |
|---|---|---|
| GB | 2476821 | 7/2011 |
| JP | 2010203025 | 9/2010 |

OTHER PUBLICATIONS

The Sharp Collar, at http://www.thesharpcollar.com/, 2 pages, last accessed Jun. 29, 2019.

Slick Collar, at https://slickcollar.com/, 10 pages, last accessed Jun. 29, 2019.

Stiff Collar Stay, at https://www.stiffcollarstay.com/, 3 pages, last accessed Jun. 29, 2019.

Two Pair Magnetic Power Stays Collar Stays, at https://wurkinstiffs.com/collections/magnetic-collar-solutions/products/two-pair-magnetic-power-stays, 4 pages, last accessed May 7, 2021.

* cited by examiner

SHIRT COLLAR STIFFENING DEVICE

CROSS-REFERENCE TO RELATED APPLICATIONS

This application claims priority to U.S. Provisional Application Ser. No. 63/022,232, filed May 8, 2020, the contents of which are incorporated herein by reference in its entirety.

FIELD OF THE INVENTION

The present technology relates generally to fashion accessories, and more particularly to adjustable collar stays to provide form and structure to a collar of a garment.

BACKGROUND

Many shirts, especially men's dress shirts, and other garments have foldable collars. It can be difficult to keep the points of the collar flat, especially when not wearing a tie, which can lead to an unkempt appearance. It is known to insert collar stays into channels or pockets at the shirt collar corners or to permanently embed them in the collar at the time of manufacture. Such collar stays help keep the collar points flat, but not necessarily in a desired position, and do not help maintain a neat appearance of the rest of the collar.

BRIEF SUMMARY OF THE DISCLOSURE

In one embodiment of the invention, a shirt collar stiffening device comprises an elongated bendable main body, a first elongated bendable length adjustment member, a second elongated bendable length adjustment member, a first collar stay member pivotably attached to the first length adjustment member, and a second collar stay member pivotably attached to the second length adjustment member. The elongated bendable main body has a first end, a second end opposite the first end, a first side, a second side opposite the first side, a first plurality of loops projecting outward from the first side, and a second plurality of loops projecting outward from the second side. The first elongated bendable length adjustment member has a proximal end and an opposing distal end, and is slidably engageable with the main body by inserting the proximal end of the first length adjustment member through two of more of the first plurality of loops of the main body. The second elongated bendable length adjustment member has a proximal end and an opposing distal end, and is slidably engageable with the main body by inserting the proximal end of the second length adjustment member through two of more of the second plurality of loops of the main body. A longitudinal axis of the first length adjustment member is parallel to a longitudinal axis of the main body when the first length adjustment member is slidably engaged with the main body. A longitudinal axis of the second length adjustment member is parallel to the longitudinal axis of the main body when the second length adjustment member is slidably engaged with the main body.

One or more slits may be defined in a side edge of the first length adjustment member. The one or more slits defined in a side edge of the first length adjustment member are positioned to selectively receive at least a portion of the first collar stay member and to selectively retain the first collar stay member in a position in which a longitudinal axis of the first collar stay member is parallel to the longitudinal axis of the main body. One or more slits may be defined in a side edge of the second length adjustment member. The one or more slits defined in a side edge of the second length adjustment member are positioned to selectively receive at least a portion of the second collar stay member and to selectively retain the second collar stay member in a position in which a longitudinal axis of the second collar stay member is parallel to the longitudinal axis of the main body.

The first plurality of loops projecting outward from the first side and the second plurality of loops projecting outward from the second side may alternate along a length of the main body.

BRIEF DESCRIPTION OF THE SEVERAL VIEWS OF THE DRAWINGS

Reference will now be made to the accompanying drawings, which are not necessarily drawn to scale. The following detailed description of the disclosure will be better understood when read in conjunction with the appended drawings. It should be understood, however, that the disclosure is not limited to the precise arrangements and instrumentalities shown. In the drawings.

DETAILED DESCRIPTION OF THE DISCLOSURE

Figure 1:
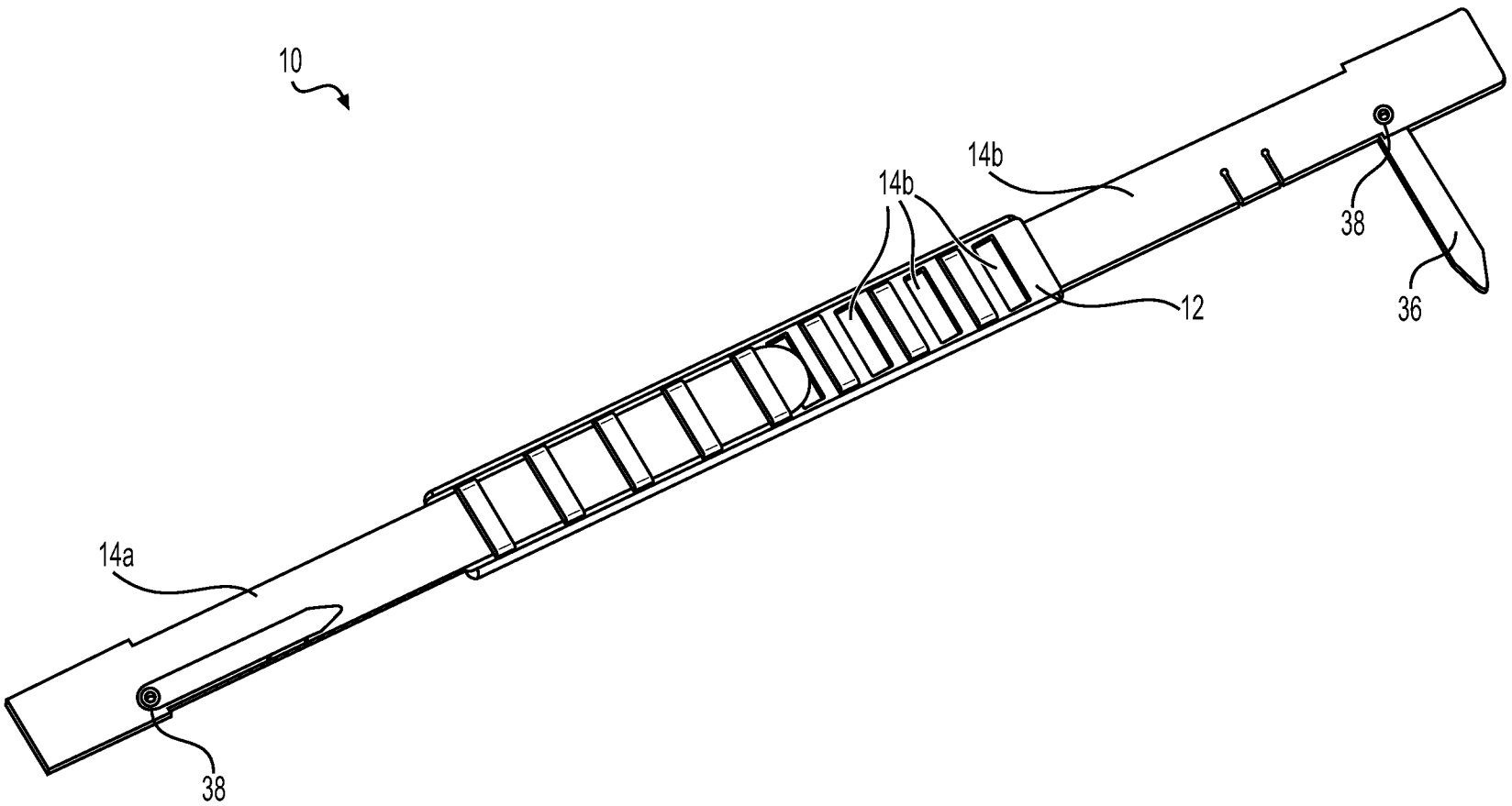
FIG. 1 is a perspective view of a shirt collar stiffening device, in accordance with embodiments of the invention.

Certain terminology is used in the following description for convenience only and is not limiting. The words "lower," "bottom," "upper," "top," "left" and "right" and the like designate directions in the drawings to which reference is made. The words "inwardly," "outwardly," "upwardly" and "downwardly" and the like refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention are directed to a novel collar stiffening device. A collar stiffening device helps keep a shirt collar straight, flat, and neat. Referring to the figures, the collar stiffening device 10 of embodiments of the invention comprises a medial portion 12 (which may also be termed a main body) and two distal portions 14*a, b* (which may also be termed length adjustment members) which are slidably engageable with the central portion 12. The distal portions may be termed a first side distal portion 14*a* and a second side distal portion 14*b*. In the illustrated embodiment, the two distal portions 14*a, b* are structurally identical (they are flipped 180 degrees for engagement with the central portion 12).

Figure 2:
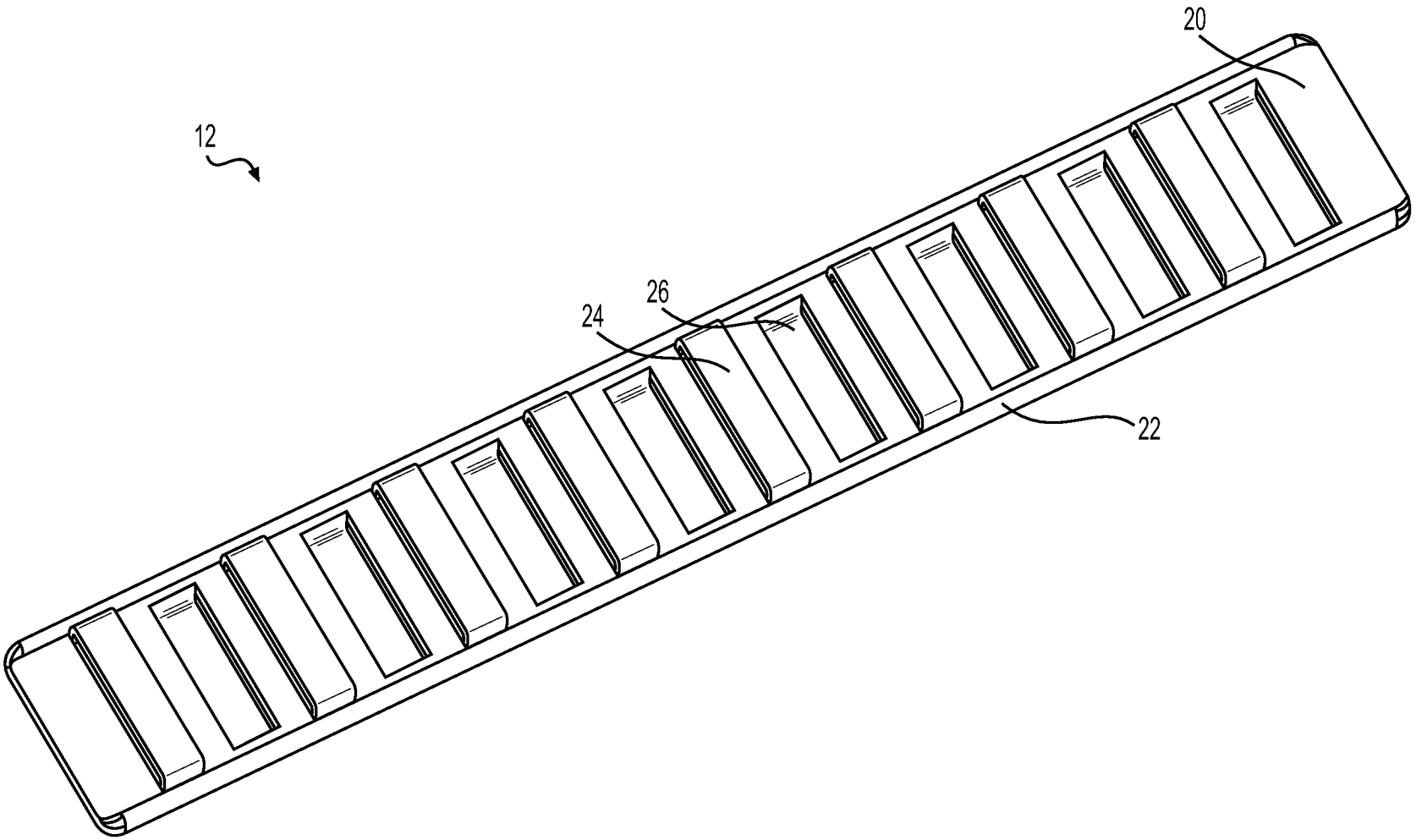
FIG. 2 is a front perspective view of the center portion of the shirt collar stiffening device of FIG. 1.
Figure 3:
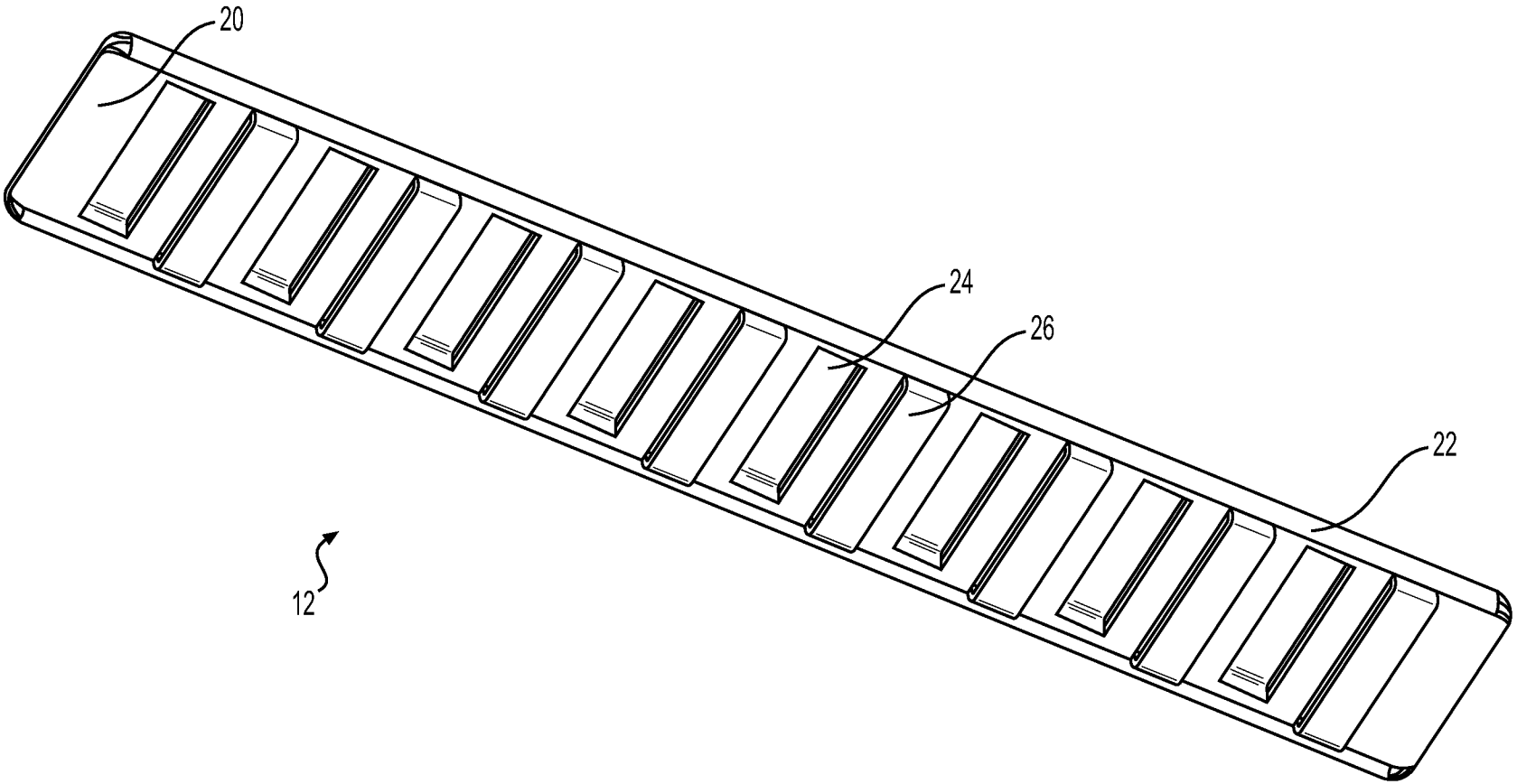
FIG. 3 is a rear perspective view of the center portion of the shirt collar stiffening device of FIG. 1.
Figure 4:
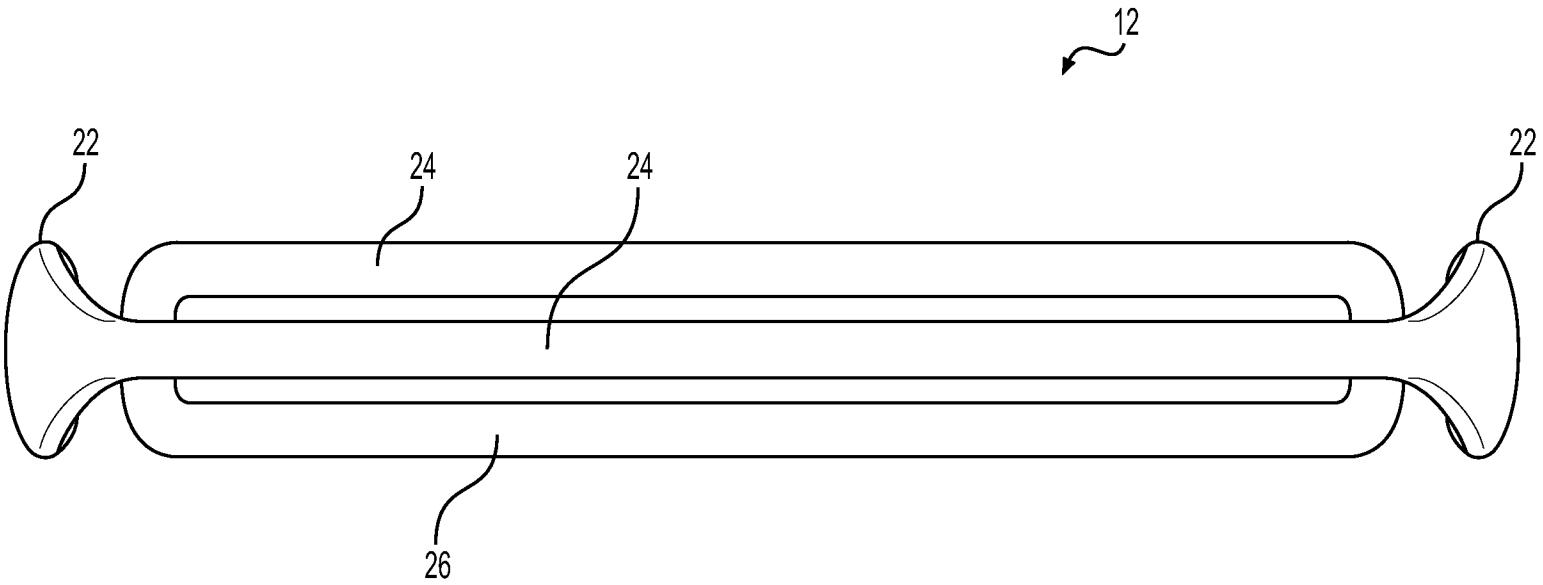
FIG. 4 is an end view of the center portion of the shirt collar stiffening device of FIG. 1.

The central portion 12 comprises a, elongated, flat, but bendable main body 20 with opposing raised sides 22 on the long edges. A series of parallel, spaced-apart protrusions or loops are molded into the main body 20. In the illustrated embodiment, eight protrusions 24 protrude toward a first side of the main body 20 (protruding forward based on the orientation shown in FIG. 2) and eight protrusions 26 protrude toward a second side of the main body 20 (protruding backward based on the orientation shown in FIG. 2). The first side protrusions 24 and the second side protrusions 26 alternate. Each protrusion defines a gap between the back side of each protrusion and the corresponding side of the main body 20. The gap is sized such that each of the distal portions 14*a, b* can be readily slidably inserted between the protrusions on a corresponding side and the main body 20. Specifically, the first side distal portion 14*a* is inserted between the first side protrusions 24 and the corresponding side of the main body 20, and the second side distal portion 14*b* is inserted between the second side protrusions 26 and the corresponding side of the main body 20.

Any suitable size, shape, and pattern of protrusions may be used in the central portion to define the gaps into which the distal portions are inserted. For example, repeating arcs, circles, Xs, or wave patterns may be used.

The central portion 12 is constructed of any suitable material that is durable, flexible, and has sufficiently high friction to retain the distal portions 14*a, b* in slidable engagement when the central portion is curved in use (the distal portions 14*a, b* should slide easily into engagement with the central portion 12 when the central portion 12 is flat). In one specific embodiment, the central portion is constructed of 90A durometer urethane. The central portion 12 should be molded flat or nearly flat so that it tends to want to straighten out when curved, thereby providing force against the distal portions 14*a, b* when curved to help retain the distal portions 14*a, b* in slidable engagement with the central portion 12.

Each distal portion 14*a, b* comprises an elongated flat, but bendable main body 30 having an insertion end 32 (which may also be termed a proximal end) and a distal end 34. The insertion end 32 is preferably rounded (as shown) or tapered (not shown) to enable easy slidable engagement with the central portion 12. The distal end 34 is slightly wider than the rest of the main body to prevent the distal end from slidably engaging with the central portion 12. A collar stay portion 36 is pivotably affixed to each distal portion 14*a, b* via pivot point 38 using any suitable pivotable attachment mechanism or method. Each collar stay portion 36 is pivotably affixed a short distance from the distal end of its corresponding distal portion 14*a, b*. Each collar stay portion 36 is shaped generally like a conventional collar stay, having an elongated body with a tapered or curved distal end.

Figure 5:
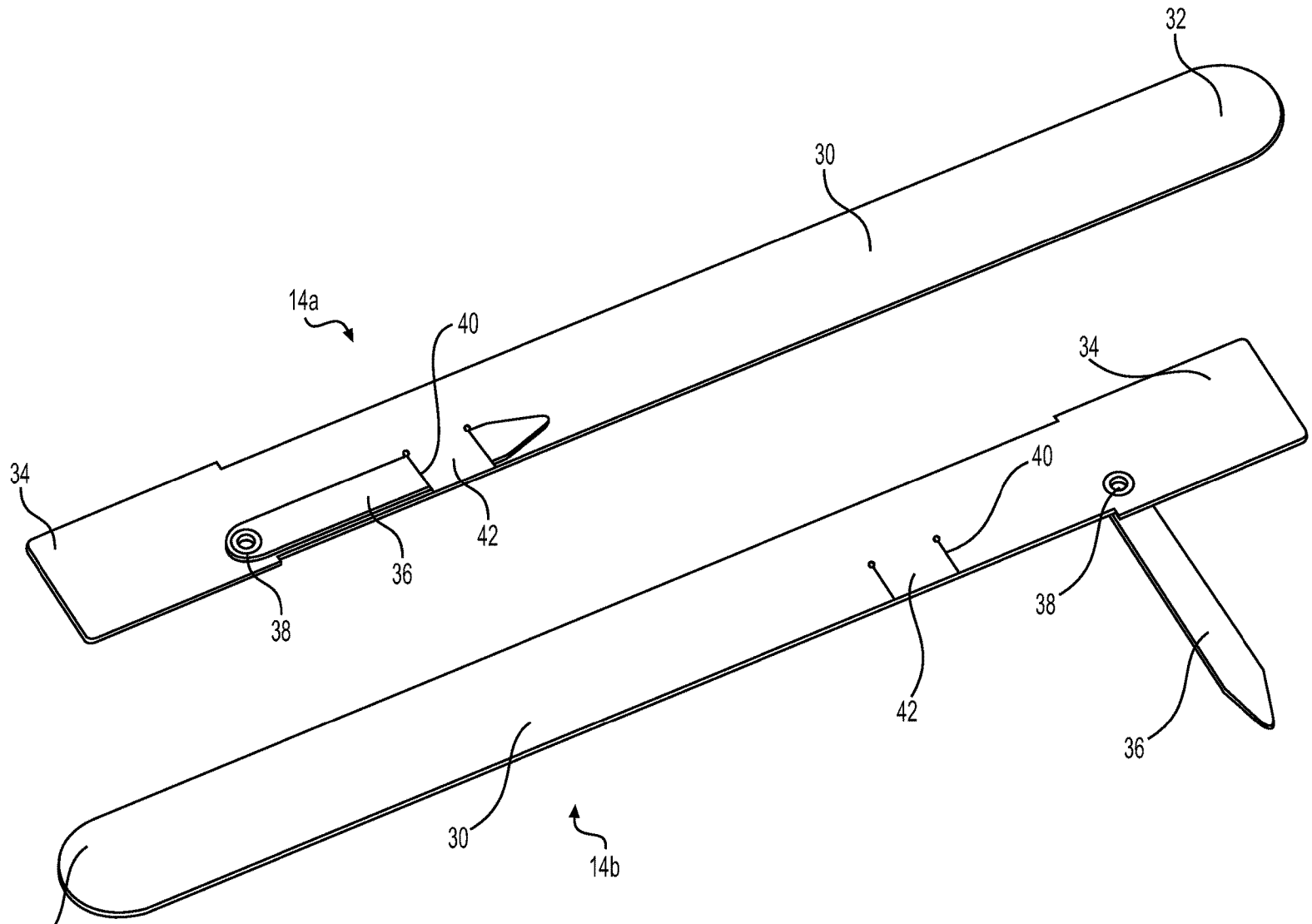
FIG. 5 is a perspective view of the distal portions of the shirt collar stiffening device of FIG. 1.

Each distal portion 14*a, b* has two parallel slits 40 defined in its main body 30. The slits 40 extend from one edge of the main body 30 to about the middle of the main body 30, thereby forming a bendable tab 42. The slits 40 and bendable tab 42 enable the collar stay portion 36 to be retained in a non-use position in which the collar stay portion is parallel with and does not protrude from the side of its corresponding distal portion 14*a, b*. In this non-use position, the collar stay portion 36 is slid into one or preferably both of the slits 40 of the corresponding main body 30. This non-use position is illustrated with the first side distal portion 14*a* in FIGS. 1 and 5, with FIG. 5 showing the retention of the collar stay portion 36 by the bendable tab 42. The non-use position is advantageous when the collar stiffening device 10 of embodiments of the invention is used with a shirt that does not have collar stay pockets to receive collar stays.

The distal portions are constructed of any suitable material that is durable and flexible enough to be readily curved along its long axis for placement under a shirt collar yet stiff enough to not readily bend along its short axis. In one specific embodiment, the distal portions are constructed of polypropylene sheet material with a texture equivalent to SPI-C1.

Figure 6:
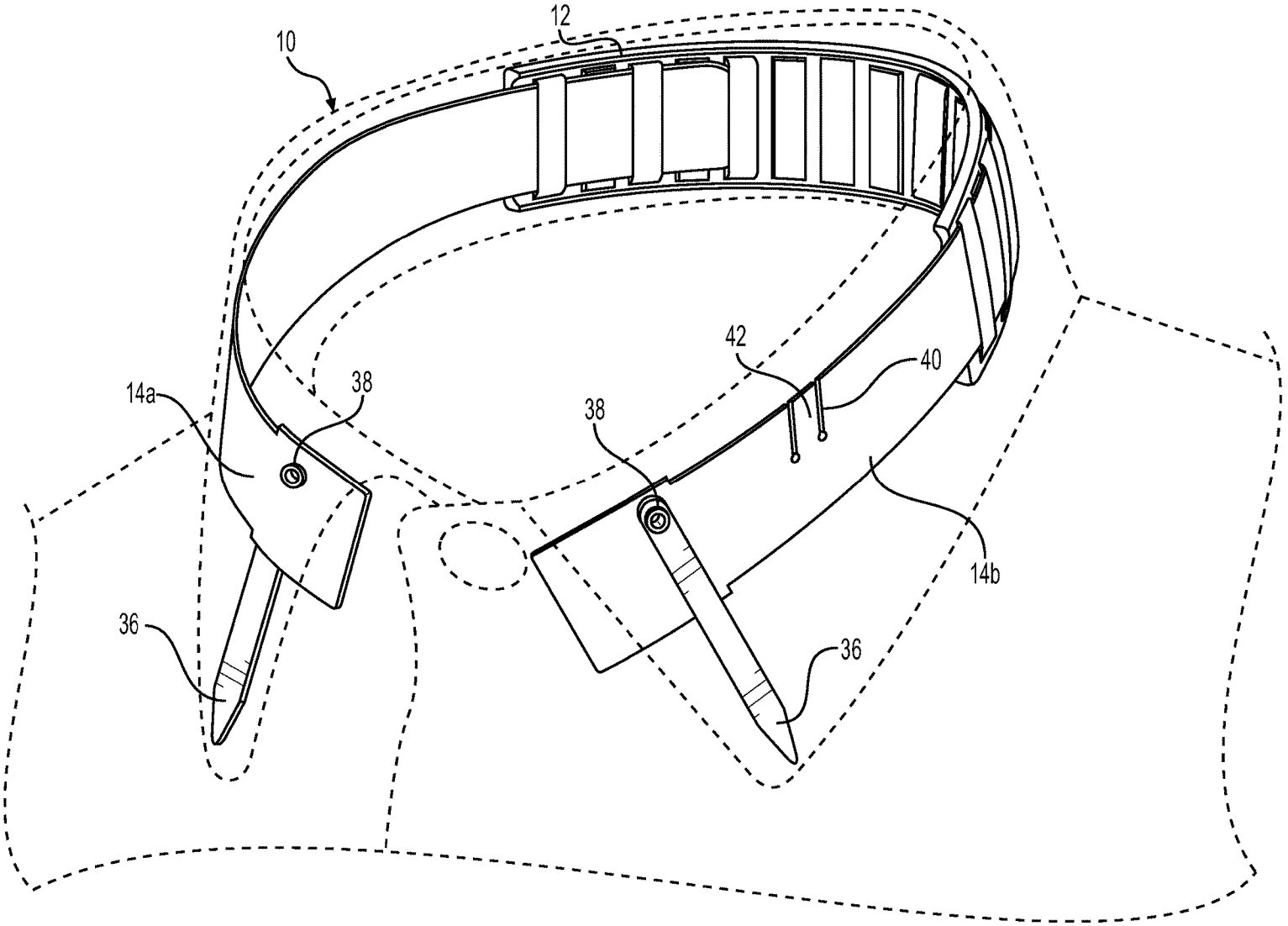
FIG. 6 is a perspective view of the shirt collar stiffening device of FIG. 1 in use, in accordance with alternative embodiments of the invention.

In use, the collar stiffening device of embodiments of the invention is placed under a shirt collar as shown in FIG. 6. The length of the device may be adjusted as needed by sliding one or both distal portions 14*a, b* toward or away from the middle of the central portion 12. The length is typically adjusted such that the device extends most of the way around a user's neck without being visible in the front collar gap. If the collar has collar stay pockets, each collar stay portion 36 is inserted into a respective collar stay pocket.

The collar stiffening device of embodiments of the invention may be any suitable size. In one exemplary embodiment of the invention, the main body of the central portion is about eight inches long, about 1.13 inches wide, and about 0.12 inches thick; the distal portions are about 9.5 inches long, about 0.97 inches wide at the distal end, about 0.86 inches wide at the insertion end, about 0.017 inches thick, and the wider distal end portion is about 1.5 inches long; the collar stay portion is about 2.5 inches long, about 0.31 inches wide, and about 0.030 inches thick; the collar stay portion is attached to the main body 30 about 1.38 inches from the distal end and about 0.25 inches from the near edge; and the radius of the insertion end is about 0.43 inches.

Figure 7:
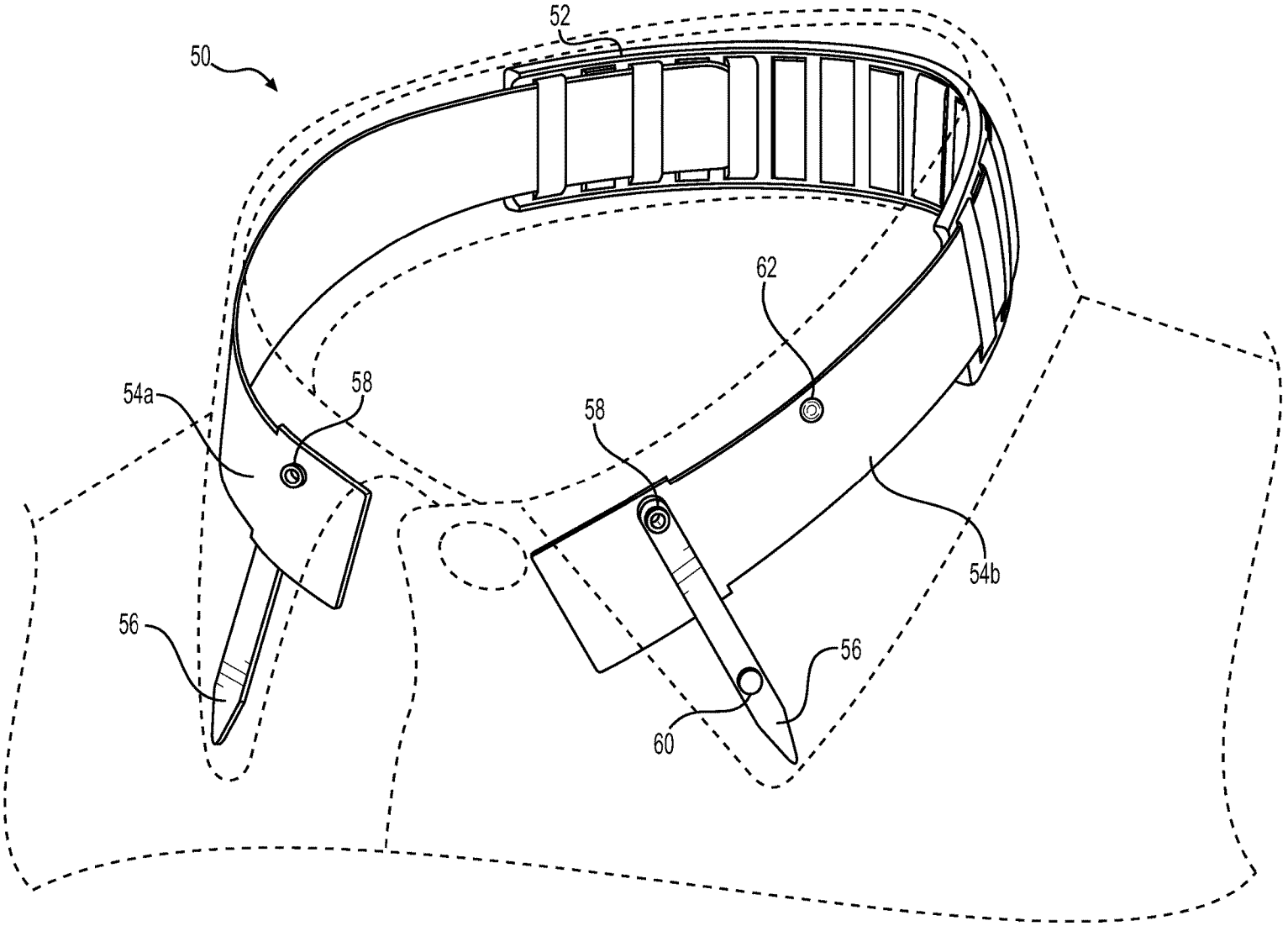
FIG. 7 is a perspective view of a shirt collar stiffening device in use, in accordance with alternative embodiments of the invention.

FIG. 7 illustrates a collar stiffening device of alternative embodiments of the invention in use in a shirt collar. The collar stiffening device 50 of FIG. 7 comprises a medial portion 52 and two distal portions 54*a, b* which are slidably engageable with the central portion 12. A collar stay portion 56 is pivotably affixed to each distal portion 54*a, b* via pivot point 58 using any suitable pivotable attachment mechanism or method. The collar stiffening device 50 of FIG. 7 omits the parallel slits. Each collar stay portion 56 includes a small magnet 60 at or near its distal end. The magnets 60 are typically disk or button magnets and may be affixed to the collar stay portion 56 in any suitable way (typically using a strong adhesive). The magnet 60 may be affixed to either or both sides of the collar stay portion 56. Any suitable type of magnet may be used, such as a rare earth (e.g., neodymium) magnet.

When the device of FIG. 7 is in use, a magnetic decorative element (not illustrated) may be placed on the exterior of the collar adjacent the magnet 60 and the decorative element will be held in place by the magnetic force. This enables a user to display a decorative element on the user's collar without the damage to the fabric that occurs when attaching a pin. Such a decorative element may comprise a vast number of different symbols, such as the user's initials (monogram), flags, affiliation symbols (e.g., college, fraternal organization, etc.), religious symbols (e.g., cross, fish, Star of David, etc.), sports team logos, or purely decorative elements (e.g., colored stone, rhinestone, etc.). Advantageously, adding such a magnetic element outside the collar would enable the collar stiffening device 50 to keep a shirt collar straight, flat, and neat even when used with a shirt that does not have collar stay pockets to receive collar stays, as the attraction between the magnetic element and the magnet on the collar stay portion would hold the collar in place.

Instead of the parallel slits of the embodiment of FIGS. 1-6, the device of FIG. 7 comprises a magnetic element 62 (e.g., a rivet) affixed to each of the distal portions 54*a, b* at about the same location as the slits. The magnetic element interacts with the magnet 60 to retain the collar stay portion 56 in a non-use position in which the collar stay portion 56 is parallel with and does not protrude from the side of its corresponding distal portion 54*a, b*.

In another alternative embodiment similar to the embodiment of FIG. 7 (not illustrated), the collar stay portions each comprise a magnetic element instead of a magnet and the distal portions each comprise a magnet instead of a magnetic element. In such an alternative embodiment, the decorative element would require a magnet to adhere the decorative element to the magnetic element of the collar stay portion.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A shirt collar stiffening device comprising:

an elongated bendable main body having a first end, a second end opposite the first end, a first side, a second side opposite the first side, a first plurality of loops projecting outward from the first side, and a second plurality of loops projecting outward from the second side;

a first elongated bendable length adjustment member having a proximal end and an opposing distal end, the first length adjustment member being slidably engageable with the main body by inserting the proximal end of the first length adjustment member through two or more of the first plurality of loops of the main body;

a second elongated bendable length adjustment member having a proximal end and an opposing distal end, the second length adjustment member being slidably engageable with the main body by inserting the proximal end of the second length adjustment member through two or more of the second plurality of loops of the main body;

a first collar stay member pivotably attached to the first length adjustment member; and a second collar stay member pivotably attached to the second length adjustment member;

wherein a longitudinal axis of the first length adjustment member is parallel to a longitudinal axis of the main body when the first length adjustment member is slidably engaged with the main body; and wherein a longitudinal axis of the second length adjustment member is parallel to the longitudinal axis of the main body when the second length adjustment member is slidably engaged with the main body.

2. The shirt collar stiffening device of claim 1, wherein one or more slits are defined in a side edge of the first length adjustment member, the one or more slits being positioned to selectively receive at least a portion of the first collar stay member and to selectively retain the first collar stay member in a position in which a longitudinal axis of the first collar stay member is parallel to the longitudinal axis of the main body; and wherein one or more slits are defined in a side edge of the second length adjustment member, the one or more slits being positioned to selectively receive at least a portion of the second collar stay member and to selectively retain the second collar stay member in a position in which a longitudinal axis of the second collar stay member is parallel to the longitudinal axis of the main body.

3. The shirt collar stiffening device of claim 1, wherein the first plurality of loops projecting outward from the first side and the second plurality of loops projecting outward from the second side alternate along a length of the main body.

4. The shirt collar stiffening device of claim 1, further comprising:

a first magnet affixed to or integral with the first collar stay member; and a second magnet affixed to or integral with the second collar stay member.

5. The shirt collar stiffening device of claim 4, further comprising:

a first magnetic element affixed to or integral with the first length adjustment member, the first magnetic element being positioned to selectively magnetically adhere to the first magnet of the first collar stay member and thereby selectively retain the first collar stay member in a position in which a longitudinal axis of the first collar stay member is parallel to the longitudinal axis of the main body; and a second magnetic element affixed to or integral with the second length adjustment member, the second magnet being positioned to selectively magnetically adhere to the second magnet of the second collar stay member and thereby selectively retain the second collar stay member in a position in which a longitudinal axis of the second collar stay member is parallel to the longitudinal axis of the main body.

6. The shirt collar stiffening device of claim 1, further comprising:

a first ferrous element affixed to or integral with the first collar stay member; and a second ferrous element affixed to or integral with the second collar stay member.

7. The shirt collar stiffening device of claim 6, further comprising:

a first magnet affixed to or integral with the first length adjustment member, the first magnet being positioned to selectively magnetically adhere to the first ferrous element of the first collar stay member and thereby selectively retain the first collar stay member in a position in which a longitudinal axis of the first collar stay member is parallel to the longitudinal axis of the main body; and a second magnet affixed to or integral with the second length adjustment member, the second magnet being positioned to selectively magnetically adhere to the second ferrous element of the second collar stay member and thereby selectively retain the second collar stay member in a position in which a longitudinal axis of the second collar stay member is parallel to the longitudinal axis of the main body.

8. A shirt collar stiffening device comprising:

an elongated bendable main body having a first end, a second end opposite the first end, a first side, a second side opposite the first side, a first plurality of loops projecting outward from the first side, and a second plurality of loops projecting outward from the second side;

a first elongated bendable length adjustment member having a proximal end and an opposing distal end, the first length adjustment member being slidably engageable with the main body by inserting the proximal end of the first length adjustment member through two or more of the first plurality of loops of the main body;

a second elongated bendable length adjustment member having a proximal end and an opposing distal end, the second length adjustment member being slidably engageable with the main body by inserting the proximal end of the second length adjustment member through two or more of the second plurality of loops of the main body;

a first collar stay member pivotably attached to the first length adjustment member; and a second collar stay member pivotably attached to the second length adjustment member;

wherein a longitudinal axis of the first length adjustment member is parallel to a longitudinal axis of the main body when the first length adjustment member is slidably engaged with the main body;

wherein a longitudinal axis of the second length adjustment member is parallel to the longitudinal axis of the main body when the second length adjustment member is slidably engaged with the main body;

wherein one or more slits are defined in a side edge of the first length adjustment member, the one or more slits being positioned to selectively receive at least a portion of the first collar stay member and to selectively retain the first collar stay member in a position in which a longitudinal axis of the first collar stay member is parallel to the longitudinal axis of the main body; and wherein one or more slits are defined in a side edge of the second length adjustment member, the one or more slits being positioned to selectively receive at least a portion of the second collar stay member and to selectively retain the second collar stay member in a position in which a longitudinal axis of the second collar stay member is parallel to the longitudinal axis of the main body.

9. The shirt collar stiffening device of claim 8, wherein the first plurality of loops projecting outward from the first side and the second plurality of loops projecting outward from the second side alternate along a length of the main body.

10. A shirt collar stiffening device comprising:

an elongated bendable main body having a first end, a second end opposite the first end, a first side, a second side opposite the first side, a first plurality of loops projecting outward from the first side, and a second plurality of loops projecting outward from the second side;

a first elongated bendable length adjustment member having a proximal end and an opposing distal end, the first length adjustment member being slidably engageable with the main body by inserting the proximal end of the first length adjustment member through two or more of the first plurality of loops of the main body;

a second elongated bendable length adjustment member having a proximal end and an opposing distal end, the second length adjustment member being slidably engageable with the main body by inserting the proximal end of the second length adjustment member through two or more of the second plurality of loops of the main body;

a first collar stay member pivotably attached to the first length adjustment member, the first collar stay member having a first magnet affixed thereto or integral therewith;

a second collar stay member pivotably attached to the second length adjustment member, the second collar stay member having a second magnet affixed thereto or integral therewith;

wherein a longitudinal axis of the first length adjustment member is parallel to a longitudinal axis of the main body when the first length adjustment member is slidably engaged with the main body; and wherein a longitudinal axis of the second length adjustment member is parallel to the longitudinal axis of the main body when the second length adjustment member is slidably engaged with the main body.

11. The shirt collar stiffening device of claim 10, further comprising:

a first magnetic element affixed to or integral with the first length adjustment member, the first magnetic element being positioned to selectively magnetically adhere to the first magnet of the first collar stay member and thereby selectively retain the first collar stay member in a position in which a longitudinal axis of the first collar stay member is parallel to the longitudinal axis of the main body; and a second magnetic element affixed to or integral with the second length adjustment member, the second magnet being positioned to selectively magnetically adhere to the second magnet of the second collar stay member and thereby selectively retain the second collar stay member in a position in which a longitudinal axis of the second collar stay member is parallel to the longitudinal axis of the main body.

12. The shirt collar stiffening device of claim 10, wherein the first plurality of loops projecting outward from the first side and the second plurality of loops projecting outward from the second side alternate along a length of the main body.

* * * * *